US007026947B2

(12) United States Patent
Faltesek et al.

(10) Patent No.: US 7,026,947 B2
(45) Date of Patent: Apr. 11, 2006

(54) BUILDING EMERGENCY PATH FINDING SYSTEMS AND METHOD

(75) Inventors: Anthony E. Faltesek, Roseville, MN (US); Ranjana G. Deshpande, Minneapolis, MN (US)

(73) Assignee: Honeywell International, Inc., Morristown, NJ (US)

( * ) Notice: Subject to any disclaimer, the term of this patent is extended or adjusted under 35 U.S.C. 154(b) by 101 days.

(21) Appl. No.: 10/735,363

(22) Filed: Dec. 12, 2003

(65) Prior Publication Data

US 2005/0128070 A1 Jun. 16, 2005

(51) Int. Cl.
*G08B 1/08* (2006.01)
*G08B 19/00* (2006.01)
*G08B 29/00* (2006.01)

(52) U.S. Cl. ..... 340/691.1; 340/539.1; 340/511; 340/521; 340/538.11

(58) Field of Classification Search ..... 340/691.1, 340/692, 577, 627–632, 332, 286.01, 539.1, 340/511, 521, 522, 538.16; 116/205
See application file for complete search history.

(56) References Cited

U.S. PATENT DOCUMENTS

| | | | | |
|---|---|---|---|---|
| 4,074,225 | A | 2/1978 | Vandeweghe | |
| 4,385,586 | A * | 5/1983 | Schriever | 116/205 |
| 4,754,266 | A | 6/1988 | Shand et al. | |
| 4,796,018 | A | 1/1989 | Nakanishi et al. | |
| 4,801,928 | A | 1/1989 | Minter | |
| 5,140,301 | A * | 8/1992 | Watanabe | 340/332 |
| 5,572,183 | A * | 11/1996 | Sweeney | 340/332 |
| 5,642,092 | A | 6/1997 | Dunne et al. | |
| 6,113,839 | A | 9/2000 | McAllister | |
| 6,114,948 | A | 9/2000 | Astell | |
| 6,150,943 | A * | 11/2000 | Lehman et al. | 340/628 |
| 6,249,221 | B1 | 6/2001 | Reed | |
| 6,313,549 | B1 | 11/2001 | Moisan et al. | |
| 6,499,421 | B1 * | 12/2002 | Honigsbaum | 116/205 |
| 6,529,128 | B1 | 3/2003 | Weng | |
| 6,529,137 | B1 | 3/2003 | Roe | |
| 6,646,545 | B1 * | 11/2003 | Bligh | 340/286.05 |
| 6,842,120 | B1 * | 1/2005 | Colberg et al. | 340/691.1 |
| 6,873,256 | B1 * | 3/2005 | Lemelson et al. | 340/539.1 |
| 2002/0057204 | A1 | 5/2002 | Bligh | |
| 2002/0149491 | A1 | 10/2002 | Crandall | |
| 2002/0167408 | A1 | 11/2002 | Trajkovic et al. | |
| 2003/0051379 | A1 | 3/2003 | Williams, Jr. | |

FOREIGN PATENT DOCUMENTS

| | | | |
|---|---|---|---|
| GB | 2214681 A | * | 9/1989 |
| GB | 2312982 A | * | 11/1997 |

OTHER PUBLICATIONS

International Search Report, PCT/US04/34731.
Written Opinion of the International Searching Authority, dated Jun. 7, 2005, PCT/US04/34731.

* cited by examiner

*Primary Examiner*—Jeffery Hofsass
*Assistant Examiner*—Lam Pham
(74) *Attorney, Agent, or Firm*—Welsh & Katz, Ltd.

(57) ABSTRACT

Signals from a plurality of detectors are evaluated to establish an ingress or an egress path or paths to and from a region. Where the detectors indicate flame or smoke concentrations, the ingress paths lead first responders to the source of the flame or smoke while egress paths lead evacuees away from the flame or smoke.

25 Claims, 4 Drawing Sheets

BUILDING EMERGENCY PATH FINDING SYSTEMS AND METHOD

FIELD OF THE INVENTION

The invention pertains to regional monitoring systems. More particularly, the invention pertains to such systems which establish ingress and/or egress paths in response to developing hazardous conditions.

BACKGROUND

During emergency situations in buildings, evacuees can have difficulty finding safe egress routes out of the building. These difficulties can be an artifact of the condition creating the emergency such as earthquakes collapsing egress routes, or fire filling an egress route with smoke.

In conditions where it is difficult to find a safe way out of a building, indications as to which of the escape routes is/are safe, and indications of how to get to that escape route(s) can be very valuable. In more severe emergencies such as earthquakes, parts of the building may have collapsed. This severe damage can block the path to safe egress routes. Further, any changes in the building due to collapses can combine with smoke and dust to be very disorienting.

In a severe fire, the whole process of finding safe escape routes may become even more difficult if thick smoke fills the entire structure. In a severe fire, evacuee panic can combine with obscuration by heavy smoke to create severe disorientation in evacuees. These difficulties can be further aggravated if the fire spreads so rapidly that escape routes are blocked or cut off by the fire.

In conditions where it might be difficult to find a safe way out of a building, indications of where the safe egress routes are would be very helpful. On the other hand, first responders, especially fire fighters, often have considerable difficulty in navigating through buildings during an emergency. Fire fighters have a hard time seeing where they are, and where they can go when smoke is thick. Fire fighters often do not know the building layout well, don't have good directions for navigating toward an identified location, and often get lost. Fire fighters also often have a hard time finding multiple objectives such as the fire, standpipes, and suspected locations of victims, which all have to be found quickly.

Fire departments need to go to the fire when they arrive at a fire scene. Even if the location of the fire is known, this can be a challenging task due to lack of knowledge of the building layout. Fire fighters also need to know other locations they may need to travel to such as water supplies, victims, or special hazards.

Medical first responders are another group that might benefit from more building information. In outdoor incidents, they are almost always guided to the victim by people because the victim is being attended to by facility people or bystanders. This may not be the case with in-building incidents.

There are also security needs for pathfinding. Attack scenarios and hostage situations are possible in the future. Such scenarios could use pathfinding to help get security forces into the building.

There continues to be a need for solutions that help evacuees get out of the building, and help first responders, especially fire fighters get into a building, and to a location or locations where they need to be. Preferably such pathfinding systems can help them navigate into and through a building with a separate set of indicators than those used by the public.

BRIEF DESCRIPTION OF THE DRAWINGS

FIG. 3-1 is a top plan view illustrating development of a hazardous condition H1 in the region of FIG. 3; and FIG. 3-2 is another top plan view illustrating further development of the hazardous condition in the region of FIG. 3.

DESCRIPTION OF THE PREFERRED EMBODIMENTS

Figure 1:
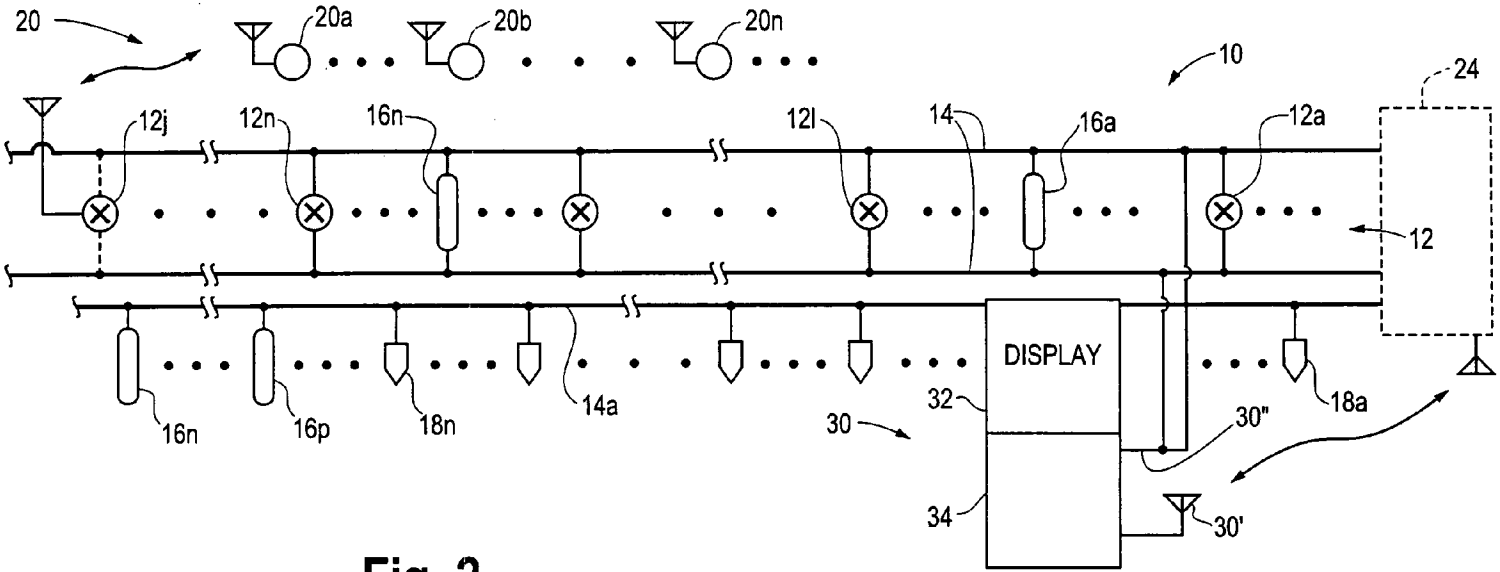
FIG. 1 is a block diagram of a system that embodies the invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

In accordance with the invention, a plurality of egress paths can be evaluated to determine whether they are safe under current conditions. Evacuees need to be effectively directed to the safe egress routes, even under difficult conditions. Potential paths which may be unsafe due perhaps to heat, smoke or other dangerous conditions are rejected and/or not presented as desirable choices.

In another embodiment, ingress paths for first responders can be evaluated. These might be different given the differing missions of various types of first responders.

Fire fighters, for example, need to be quickly directed to the seat(s) of the fire(s), to hazardous material areas, and to the sources of water. Rescue teams need to be quickly directed to victims that can not escape, or to fire teams that are in trouble.

Methods in accordance with the invention can include some or all of:

1. Identifying paths to safe egress routes. Many evacuees need to travel through a varied route to get to a safe egress like a stair tower, or fire protected corridor. That route might feel very long to an evacuee during an emergency. The evacuee needs to be confident that the path to the safe exit is known and apparent.

2. Accelerating or decelerating evacuees. Evacuees need to get moving toward egress paths quickly when there is an emergency. Depending on circumstances it may be desirable to be able to decelerate evacuees. Panic can be one of the threats to egress ways. Decelerating people, especially people behind those currently getting to a doorway, or the head of a stair can be a useful function.

3. Attracting evacuees to a specific point, or, repelling evacuees from a specific point can be useful. When an evacuation path is identified and leads evacuees to an important point, such as a doorway into an escape stair, evacuees need to move quickly toward that point rather than hesitating, or starting to search for what they should do next. However, if that specific point, such as a stair doorway, suddenly becomes unsafe because, for instance, the stair has filled with toxic smoke, the system needs to be able to direct evacuees away from that point and get them moving along another path.

Systems in accordance with the invention can include some or all of:

1. A plurality of sensors to monitor a region(s) of interest. These could include, without limitation, flame detection upon detecting heat detectors, smoke detectors, window position or integrity sensors, door security sensors, motion detectors, or door crash alarms. Such detectors could feed data into a processing system. Other sensors such as advanced image processing to detect smoke and fire, or audio sensors to detect fire, people's locations, or panic, could be added to such systems. Other types of sensors that could be used could detect panics or stampedes using image processing, or, fire and temperature detection with infrared based image processing systems.

2. Processing and detection module(s) evaluate sensor or detection inputs and determine which egress routes are safest. Such module(s) could also control path annunciation, both audibly and visually.

Without limitation, processing could include a decision tree, whose rule sets decide which routes are safe. Routes with certain sensors activated might no longer be considered safe, and, traffic could be directed away from them. This decision mechanism could automatically spread the remaining evacuation load over the available escape paths. The decision processing could alternately include artificial intelligence techniques, or neural net processing to evaluate the safety of egress routes. Whatever type(s) of processing are used to decide, activation signals would then be sent to annunication component(s). The processing software can be located, totally or in part, at one or more fire alarm control consoles or panels.

3. Annunciation indicators serve a number of functions. Indicators can be used to identify paths for egressing evacuees, and/or ingressing first responders. The annunciation indicators could also act to accelerate or decelerate evacuees. Such indicators could serve to draw evacuees to certain points, or direct them from certain points in the building.

All types of indicators come within the spirit and scope of the invention. These indicators can include traditional indication solutions such as "EXIT" signs, emergency announcement systems or strobe lights all without limitation.

Other indicators that could identify paths could include arrows on exit signs that turn on or off as needed to change the indication of where to go to find a safe exit. Indicators could include exit signs with arrows, but mounted low on the wall so they can be seen under smoke clouds. Strips can be mounted on walls to light with arrows or a line of light. Conductors with jackets that glow when the conductor is energized could light the path if they could be mounted low and in a manner that doesn't risk wear to the jacket. Such glowing conductors could be different colors for evacuees and first responder paths.

Other path indicators could include focused beams of light that provide a light path in the smoke cloud, floor mounted light strips that flash to indicate direction of travel to get to the exit, and lit signage on the exit doors themselves that indicate whether the exit is safe. Audio indicators could be used that are directional and are easily located by the human ear. Such systems could guide a person to a working exit through a zero visibility environment.

Audible indicators that output synthesized speech could be used. Such indicators or annunciators are advantageous in that their output message(s) may be varied by one or more control components.

Indicators can be place into at least two categories, those that direct evacuees out, and those that direct first responders in. Combinations of some indicators can provide path finding for both first responders and evacuees without confusing either one. For example, additional lighting could be used to demonstrate paths to first responders when joined with traditional exit lights. A small, intense, flashing light mounted on the bottom of the EXIT sign could be used by fire fighters to find their path without confusing evacuees. An audio system could be used for one type of path while a light and signage system could be used for the other. Effective combinations of indicators which provide dual pathfinding solutions come within the spirit and scope of the invention.

Pathfinding systems in accordance with the invention could be used in association with building control systems, or fire/life safety systems. They could be used alone or in combination with other types of systems.

Figure 2:
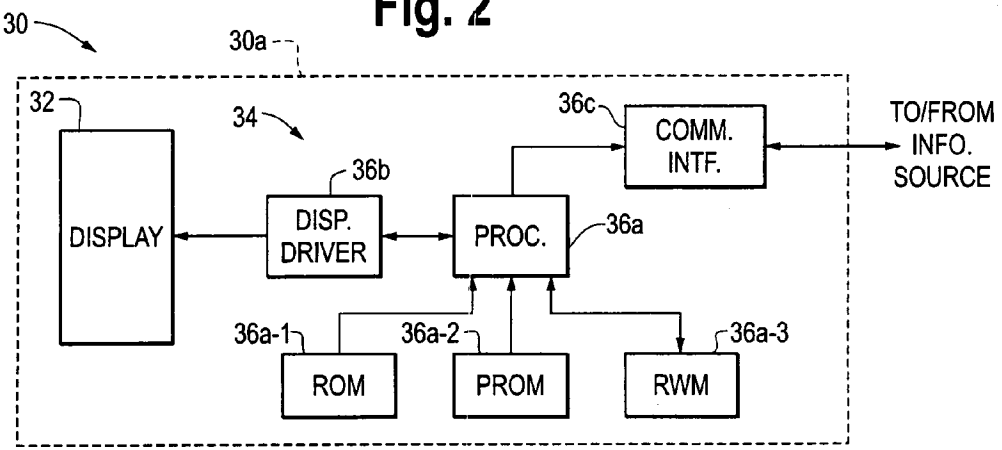
FIG. 2 is a block diagram of a portion of the system of FIG. 1.

FIGS. 1, 2 illustrate details of a system that can implement one or more of the above described methods. In FIG. 1, a system 10 incorporates a plurality of electrical units 12, including 12*a*, 12*b* . . . 12*n*, all of which can be in bi-directional communication via a communications link 14. The link 14 could be implemented as a hard-wired electrical or optical cable. Alternately, as illustrated in connection with the system 10, a plurality 20 of electrical units 20*a*, 20*b* 20*n* could communicate with one another wirelessly.

Wireless communication could be implemented using RF signals or the like without limitation. The members of the plurality 20 could be in wireless communication with one or more members, such as the member 12*j* of the plurality 12. It will be understood that the exact details of communication between electrical units, members of the plurality 12 and 20, is not a limitation of the present invention.

If desired, the system 10 could include a common control element 24, illustrated in phantom, to provide sequencing, power and supervision for the electrical units in the pluralities 12 and 20.

The members of the pluralities 12 and 20 could include ambient condition detectors as well as audible or visible output devices without limitation. Types of detectors could include fire detectors, such as flame, thermal or smoke detectors. Other types of detectors could include motion detectors, position detectors, flow detectors, velocity detectors, and the like, all without limitation. Output devices could be strobes, annunciators, or the like without limitation.

A plurality 16 of indicator devices could be scattered through a region being monitored. The plurality 16 comprises egress path indicating units, a second plurality 18, also scattered through the region comprises ingress path indicators for use by first responders. These could also be audible or visual output devices. The pluralities 16, 18 can be coupled via mediums 14*a, b* to control circuits 24.

A display device 30 is coupled to the system 10, either via hardwiring or wirelessly. It will be understood that the device 30 could be implemented as a portion of the control element 24 if desired. Alternately, the device 30 could be a separate unit from the control element 24. Device 30 could also be a portable unit which is in wireless communication with the system 10.

Device 30 includes a display unit 32 and a processing section 34. A port or ports can be provided on device 30 to connect it to system 10 wirelessly, via antenna 30' or hardwired with cable 30".

With reference to FIG. 2, a case or housing 30a contains, carries or supports the display device 32 and the processing element 34. The processing element 34 in turn includes a programmable processor 36*a* which is in communication with local read-only member 36*a*-1 and/or local programmable read-only memory 36*a*-2 and/or local read/write memory 36*a*-3.

The associated local memory incorporates executable control instructions whereby the processor 36*a* carries out an analysis and display function as described subsequently. Additionally, information as described subsequently, can be stored in the device 30 on a real-time basis or downloaded from the system 10 for display.

The processor element 34 also includes display driver circuitry 36*b* and a bi-directional communications interface 36*c* intended to be used with antenna 30' for wireless communication or to be coupled via cable 30" to communication link 14.

It will be understood that the device 30 could be permanently attached to the system 10 and provide displays only associated therewith. Alternately, the device 30 could be a stand-alone device in wireless communication with a variety of ambient condition sensing systems without limitation.

Figure 3:
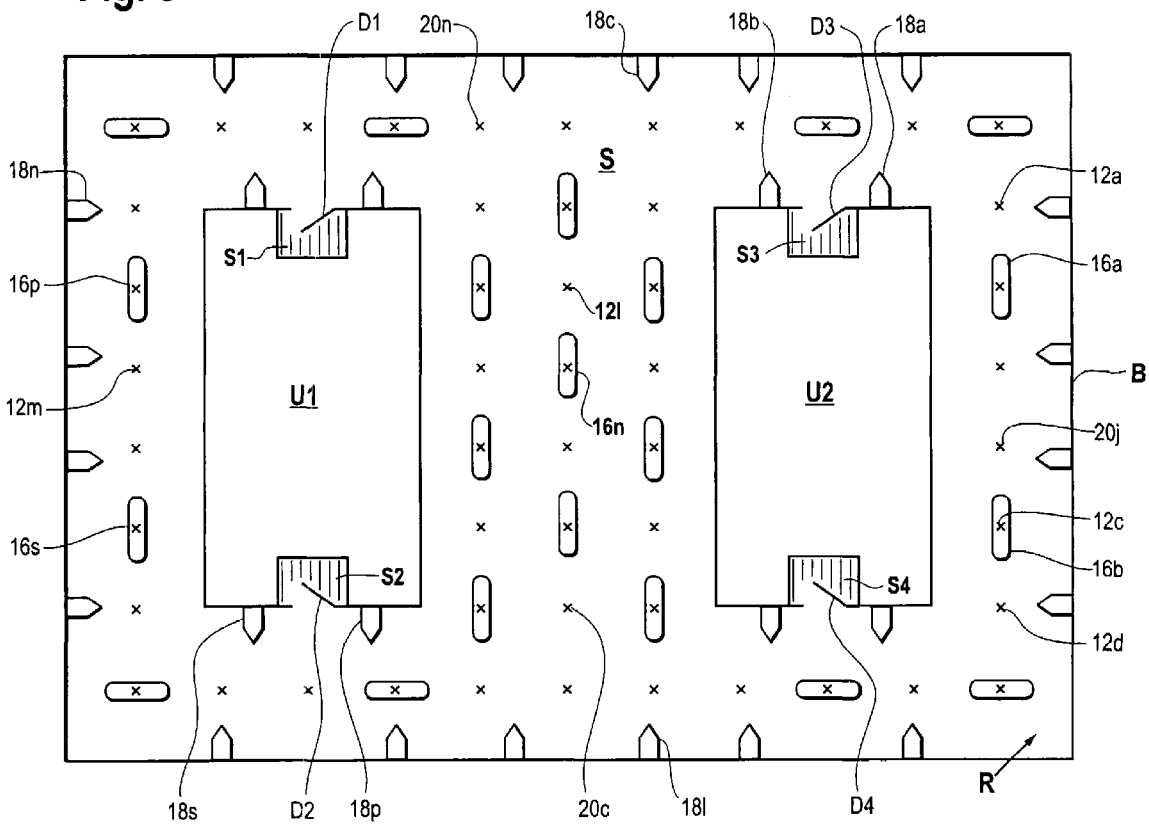
FIG. 3 is a top plan view of region R being monitored by a system as in FIG. 1.
Figures 1, 3:
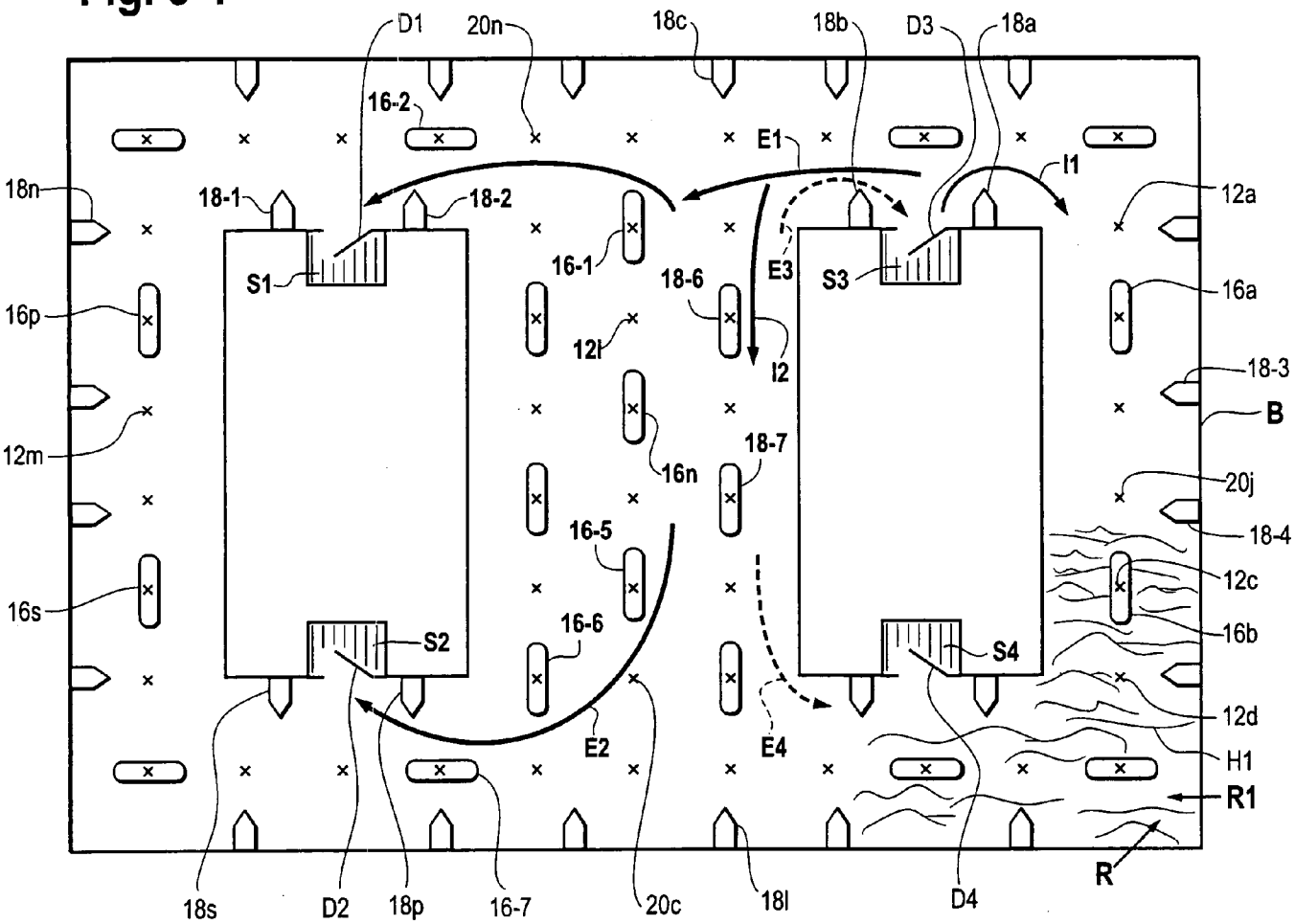
Figures 2, 3:
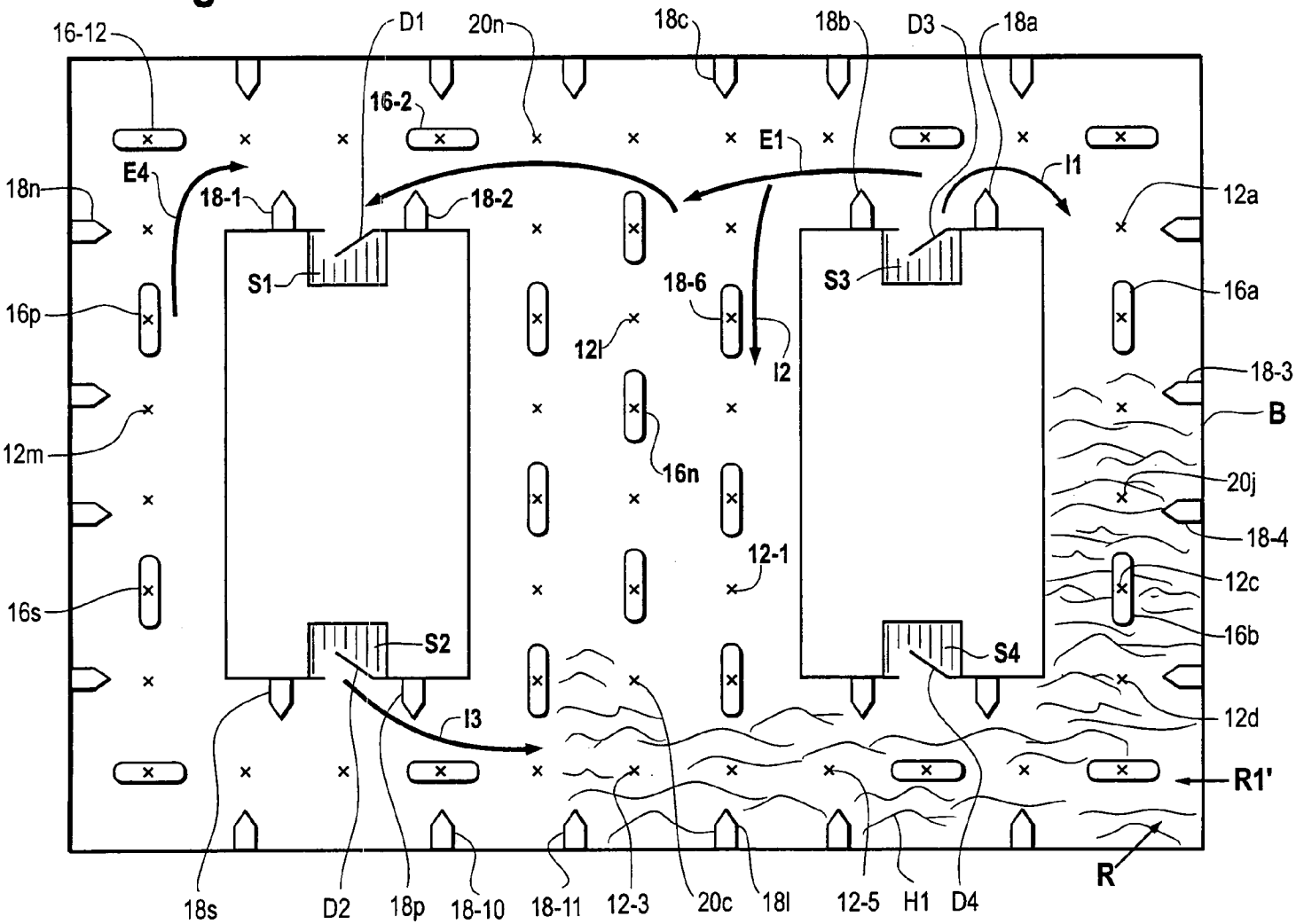

FIG. 3 illustrates an exemplary region R, illustrated as one floor of a multi-floor building B. Region R includes space S which is broken up by two spaced apart utility sections for the building U1 and U2 of a type commonly found in multi-story buildings. The sections U1, U2 include common building communications, electrical, plumbing, HVAC and the like which run vertically, floor to floor in the building as well as horizontally on a given floor such as the region R.

Sections U1, U2 also incorporate exits indicated by doors D1, D2, D3 and D4. The doors D1 . . . D4 lead to internal stairways S1 through S4 running vertically through the building B in providing ingress and egress to the various floors of the building. The stairs S1 . . . S4 are alternates to elevator service, not shown, which would also be provided through Sections U1, U2.

The region R as illustrated is monitored by the system 10. Members of the plurality of detectors 12, 20 are distributed throughout the region R, indicated by "x". The detectors are coupled via wired or wireless mediums, discussed previously, to the common system control elements 24, 30, which might be located at a ground floor level of the building B.

Region R also is equipped and wired with a plurality of annunicator or pathway indicating devices 16, 18 as discussed above. It will be understood that the devices 16, 18 can emit audible outputs including both horn, siren sounds, or voice as well as visual outputs, such as exhibited by strobe units, or, lighted displays, all without limitation. It will be understood that the details of such devices are not limitations of the present invention.

Some or all of the devices of the respective pluralities 16, 18 could be intended specifically for use in assisting individuals in the region R to evacuate that region in case of a dangerous condition such as a fire, gas or the like. Alternately, other devices of the pluralities 16, 18 could be configured and intended to assist first responders entering the region R to address the dangerous condition. It will also be understood that the detectors and output devices can be combined as desired to provide multiple functions such that an output device such as 16*b*, might be combined with a detector 12*c* all without limitation.

FIG. 3-1 illustrates an exemplary scenario in accordance with the present invention. In FIG. 3-1, a hazardous condition H1, for instance a fire or gas condition has developed in subregion R1 adjacent to door D4. This condition would be sensed by adjacent detectors such as 20*j*, 12*c*, 12*d* and others in the area. In the scenario of FIG. 3-1, the region R1 would represent a portion of the region R which evacuees should be directed away from so as to assist them in evacuating region R as safely as possible. On the other hand, first responders should be directed toward region R1 for purposes of confronting the condition and resolving same.

The system 10 upon processing the signals from the involved detectors, such as 12*c*, 12*d*, 20*j* and the like, has established evacuation paths E1 and E2 directed respectively to doors D1 and D2. In this regard, output devices would be activated by the system 10 so as to direct evacuees toward paths E1, E2 to exit via doors D1 and D2. Further, system 10 would reject potential evacuation paths such as potential evacuation paths E3, E4, indicated in phantom, as path E3 might produce a circumstance where the evacuees and the first responders had to pass one another in the stairwell S3, an undesirable situation if it could be avoided. Alternately, evacuation path E4 would be rejected since it would lead potential evacuees toward the hazardous condition H1, which is adjacent to door D4.

Path E1 is identified by audible and/or visual output devices 16-1, 16-2. It could also include additional devices configured to define an egress path such as 18-1, 18-2. Path E2 is identified by devices 16-5, -6, -7 and 18*p, s*.

Ingress path I1 could also be identified by devices 18*a*, 18-3, -4. Ingress path I2 could be defined by indicator devices 18*b*, 18-6, -7, 181. Other output variations can be implemented without departing from the spirit and scope of the invention.

System 10 in addition to establishing evacuation paths E1, E2 to assist evacuees in exiting the region R could simultaneously or subsequently establish ingress paths I1, I2 leading from stairs S3 and door D3 intended to be used by first responders entering the Region R and leading toward the hazardous condition in subregion R1. It will be understood, for example, that output devices such as output devices 16*a*, 16*b* could be activated by system 10 and provide both audible and visible clues to first responders, which would be different from audible and visual clues provided to evacuees alongs paths E1, E2. Similar comments apply to annunicators or other output devices adjacent to ingress path I2.

FIG. 3-2 illustrates region R wherein hazardous condition H1 has developed and expanded through a larger portion of the region R1'. This developing condition would be sensed for example by detectors 12-1, 12-3, 12-5 all without limitation. Responding thereto system 10 would terminate those output devices associated with indicating egress path E2 in view of the expanding hazardous condition moving toward stairway S2 and door D2. In this scenario, original evacuation path E1 would continue to be indicated as well as a new evacuation path E4.

System 10 would activate various of the annunciators or output devices so as to establish another ingress path I3, extending from door D2 toward the hazardous condition H1. Path I3 could be identified, for example, by devices 18*p*, 18-10, -11 and 181 all of which lead toward hazard H1.

The termination of evacuation path E2 and the establishment of evacuation paths E4 and ingress path I3 would preferably done in real time responding to the signals from detectors in the vicinity of hazardous condition H1. If desired, in the process of terminating evacuation path E2, both audible and visual signals could be provided evacuees in the region as to the necessity of either immediately exiting via door D2 or moving toward door D1 so as to move in a direction away from the hazardous condition H1.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modification as fall with the scope of the claims.

What is claimed is:

1. A regional information system comprising:

a plurality of detectors for monitoring a region;

control circuitry coupled to the detectors, the control circuitry at least in part in response to indicia from the detectors, establishes at least one ingress path into a portion of the region indicated by at least some of the detectors, as being the location of a hazardous condition; and which includes ingress path indicating elements coupled to the control circuits.

2. A system as in claim 1 where at least some of the ingress path indicating elements comprise electrical circuitry for emitting at least one of an audible or a visual indicium.

3. A system as in claim 1 where the control circuitry comprises at least one of tree evaluation software, neural networks implementing software, fuzzy logic software or pattern recognition software for establishing the at least one ingress path.

4. A system as in claim 1 where the control circuitry alters the at least one ingress path over time in response to the hazardous condition.

5. A system as in claim 4 where the control circuits visually identify the original ingress path and then visually identify the altered ingress path in response to the hazardous condition.

6. A system as in claim 1 where the control circuitry at least in part in response to indicia from the detectors, establishes at least one, different, egress path from the portion of the region.

7. A system as in claim 6 where the control circuitry comprises at least one of tree evaluation software, neural networks implementing software, fuzzy logic software or pattern recognition software for the establishing at least one egress path.

8. A system as in claim 6 where the control circuitry alters the at least one ingress path over time in response to the hazardous condition.

9. A system as in claim 6 where the control circuitry alters the at least one egress path in response to the hazardous condition.

10. A system as in claim 9 where the control circuits visually and audibly identify the original egress path and then the altered egress path in response to the hazardous condition.

11. A system as in claim 10 which includes a plurality of path identifying devices coupled to the control circuits.

12. A system as in claim 11 where the path identifying devices comprise at least one of visible output devices or audible output devices.

13. A system as in claim 12 which includes executable instructions for changing paths and for altering activated path identifying devices in accordance therewith.

14. A path defining system adapted for use with a plurality of regional monitoring units, the system comprising:

first circuitry to receive inputs from members of a plurality of monitoring units;

second circuitry, coupled to the first circuitry, the second circuitry processes a plurality of inputs received from the monitoring units, and responsive thereto determines at least one acceptable egress path for exiting a region while excluding at least one unacceptable path and, determines at least one, different ingress path leading to a predetermined condition; and which includes third circuitry responsive to the at least one ingress path for activating a plurality of path indicating annunciators.

15. A system as in claim 14 where the second circuitry limits acceptable egress paths to those that are associated with non-hazardous condition indicating inputs from at least some of the monitoring units.

16. A system as in claim 14 where the second circuitry excludes paths that are associated with hazardous condition indicating inputs from at least some of the monitoring units.

17. A system as in claim 14 where processing by the second circuit comprises executing a plurality of prestored instructions.

18. A system as in claim 14 where the second circuitry comprises a plurality of executable instructions for, at least in part, determining the at least one ingress path in accordance with a predetermined criterion.

19. A system as in claim 15 where, at least some of the annunciators comprise devices having at least audio outputs and others comprise devices having at least visual outputs.

20. A system as in claim 19 which includes different ingress path and egress path annunicators.

21. A system as in claim 19 with executable instructions for modifying determined paths.

22. A method comprising:

receiving a plurality of condition indicating signals from a group of different sources associated with a region;

evaluating the signals, and, responsive thereto determining an egress path from and a different ingress path into the region; and providing ingress path indicators in the region.

23. A method as in claim 22 which includes rejecting a different, potential egress path.

24. A method as in claim 22 which includes modifying the at least one egress path in response to the condition indicating signals.

25. A method as in claim 24 which includes enabling path indicating annunciators to identify the modified egress path.

* * * * *